United States Patent [19]

Aho

[11] 4,288,101

[45] Sep. 8, 1981

[54] SKI STICK HANDLE

[75] Inventor: Yrjö Aho, Westend, Finland

[73] Assignee: Exel Oy, Finland

[21] Appl. No.: 13,450

[22] Filed: Feb. 21, 1979

[30] Foreign Application Priority Data

Feb. 20, 1978 [FI] Finland ..... 780552

[51] Int. Cl.[3] ..... A44B 11/00; A63C 11/22

[52] U.S. Cl. ..... 280/821

[58] Field of Search ..... 280/11.37 B, 11.37 D, 280/11.37 H, 879, 820, 821, 822; D21/230

[56] References Cited

U.S. PATENT DOCUMENTS 3,085,814 4/1953 Scott ..... 280/11.37 H 3,560,014 2/1971 Bruckl ..... 280/821

FOREIGN PATENT DOCUMENTS 2267130 11/1975 France ..... 280/11.37 H 366481 2/1963 Switzerland ..... 280/11.37 H

*Primary Examiner*—H. Grant Skaggs

*Attorney, Agent, or Firm*—Browning, Bushman & Zamecki

[57] ABSTRACT

A handle for mounting directly on the upper end of a ski stick comprising a fitting element, a curved extension extending above the fitting element, the curved extension having a cavity space containing a buckle for longitudinally, adjustably fastening a wriststrap. An outlet for the wriststrap is in a convex side of the curved extension. The convex side extends up above the outlet to provide a relatively high face surface, the direction of the center axis of the curved extension forming an angle of between 15° to 40° with respect to the center line of the stick portion.

4 Claims, 2 Drawing Figures

SKI STICK HANDLE

The present invention relates to a knobbed portion for a ski stick handle to which a wriststrap is secured and which is connected to a straight stick portion by means of a fitting element.

In earlier types of ski stick it is known to secure the wriststrap quite near the upper edge of handle and to provide in the front side of the upper end of handle a projection in the form of a lip to prevent the hand from slipping upwards off the handle. Such types of ski sticks have been developed for a skiing style in which the hand all the time squeezes the handle which is kept in firm grip both during the thrust and the return movement of the stick. The present skiing style, at least so far as racing skiers are concerned, is such that effort is made to push the stick as far back as possible to produce as long a thrust as possible, the stick forming at the end of the thrust a direct extension of the arm, the grip being released off the handle and the stick remaining with the skier by means of a wriststrap. For easy and controlled return of the stick even from this position for renewed grip, such ski sticks were proposed in which the knob face above the wriststrap is made sufficiently high to firmly respond to the fork between thumb and index finger to properly steer the stick even though there is no finger grip on the handle. However, this solution has a drawback that, if the wriststrap is too tight, the way many skiers tend to have it, said face surface presses too strongly against the fork between thumb and index finger and said fork may get sore. Moreover, after each thrust when the lower end of the stick is coming off the ground, the ski stick rises high up in the air which slows down the return of the stick and the achievement of fast, effective skiing rhythm. Efforts have been made to overcome this drawback by bending the handle portion of a ski stick to a slight 10° to 15° angle with respect to the rest of the stick. This way said drawbacks, i.e. pressure on the fork between thumb and index finger and the bouncing of a ski stick upwards, have been reduced somewhat but not sufficiently. Additional drawbacks in these ski sticks with the handle inclined with respect to the rest of the stick are manufacturing difficulties and vibration of the stick as it hits the ground. Tubes of reinforced plastics or rich-alloy aluminum are hard to manufacture so as to make the desired bend thereon. Once it has been made on the stick, such bend results in the load on the handle tending to bend the ski stick, whereby hitting against the ground results in the vibration of the stick which is inconvenient and harmful e.g. in racing sticks.

The object of the invention is to provide a knobbed upper portion for a ski stick handle which is easy to manufacture and overcomes the above drawbacks. To achieve this object, the basis of the invention is such a known knobbed upper portion which is connected to the straight stick portion by means of a fitting element. Thus, straight stick portions can be easily manufactured conventionally and knobbed upper portions can be manufactured by injection-moulding technique as inexpensive plastic elements.

According to the present invention, the problem is solved so that the knob portion above the actual handle portion forms a curved portion with respect to the line of the stick, said curved portion arching away from the wriststrap.

This invented solution is particularly associated with a knob portion having a high face surface above the wriststrap. According to a preferred embodiment of the invention, this face surface curves so as to extend beyond the center line of the ski stick.

The curved face surface thus obtained provides sufficient control and support for the stick in its pushed-back position when grip has been loosened off the actual handle. The curved shape of the knob portion with respect to the rest of the handle, however, results in the fact that no pressure is applied on the fork between thumb and index finger, nor does the stick tend to bounce up once the thrust is over. The solution of the invention provides a lot better effect in this respect than e.g. such known solutions in which the entire handle was bent into inclined position with respect to the stick portion.

With respect to the line of the stick portion, the knob portion most preferably forms an angle of approximately 25° to 40°. This angle can thus be considerably greater than that between the bent handle and the stick portion. The height of the face surface above the wriststrap is most preferably approximately 15 to 30 mm.

Figure 1:
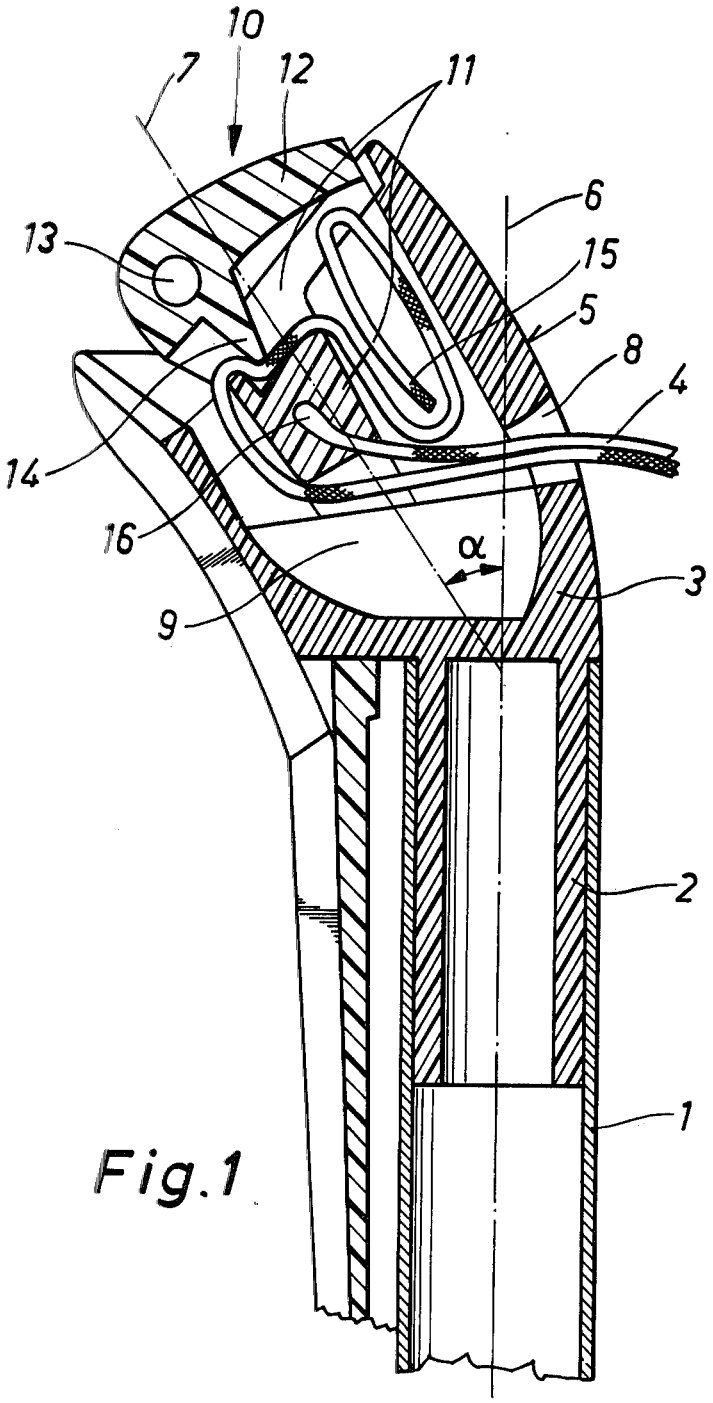
FIG. 1 is a vertical, cross-sectional view of one embodiment of the handle of the present invention.
Figure 2:
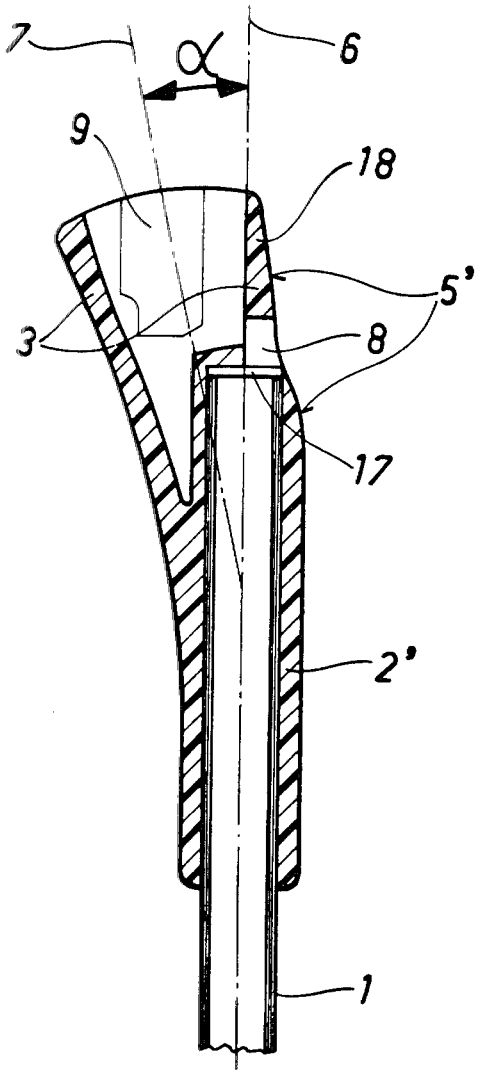
FIG. 2 is a view similar to FIG. 1 showing another embodiment of the handle of the present invention.

The following is a more detailed description of two preferred embodiments of the invention with reference made to FIGS. 1 and 2, which show the upper end of a stick in cross-section, said upper end being provided with an invented knob portion for handle.

Reference numeral 1 designates a conventional straight, tubular stick portion. By means of a fitting element 2, its upper end is fitted with a curved knob portion 3 which forcefully arches away from a wriststrap 4. It can be noted that the face surface 5 of the knob portion above the wriststrap 4 bends well beyond the center line 6 of the stick 1. The angle $\alpha$ between the axial direction 7 of knob portion and the center line 6 is between 25° to 40°, preferably about 30°. In the present embodiment, the curving of knob portion 3 begins immediately at the upper end of stick 1. Thus, the outlet 8 for wriststrap 4 is located adjacent to the center line 6 which has advantageous effect on the loading of the ski stick.

Knob portion 3 is hollow and its cavity space 9 contains a separate, removable buckle 10 to which the ends of wriststrap 4 are secured. The buckle consists of a frame portion 11 to which is journalled a lever 12 so as to be pivotable round an axis 13, said lever comprising a lip 14 which presses the free end 15 of handstrap 4 against the cross-bar of the buckle frame 11. The other end 16 of handstrap is secured inside the cross-bar of the buckle frame 11. This fitting has been effected in the injection-moulding step of frame element 11 in such a manner that end 16 has been inserted inside the injection-moulding cavity. This provides secure and inexpensive connection between frame 11 and end 16. By opening the lever 12 it is possible to lengthen or shorten the free end 15 of the strap to obtain desired length. By turning it to the position shown in the figure, the lever 12 locks the handstrap in this position. This way the knob 3 serves both to receive buckle 10 and as a means facilitating the handling of the ski stick.

In the embodiment of the FIG. 2 the same parts have been designated by the same reference numbers. The sleeve-like fitting element 2' is gripping on the exterior of stick 1 and serving simultaneously as a thickened portion forming the actual handle. This embodiment has been designed for the purpose of easy and rapid manufacturing by the injection molding technique so that only two halves of a mold is needed movable in opposite directions (the direction of the ski stick center line 6) to and from each other. To reach this purpose there is a hole 17 at the upper end of the sleeve-like fitting element 2', said hole 17 communicating with the outlet 8 for wriststrap and locating, as viewed in the direction of the ski stick center line 6, in the line with the knob wall portion 18 forming said high face surface. As can be seen from FIG. 2 the hole 17 and the knob wall portion 18 are both located immediately adjacent the ski stick center line 6 and in direction thereof. In this case the convex side 5' of the curved knob extension 3 is slightly staggered, whereby the mold portion extending through the hole 17 upwards and the other mold portion resting against the surface 5' may come into contact with each other for making the outlet opening 8 for the wriststrap.

I claim:

1. A handle for a ski stick comprising a cylindrical fitting element (2, 2') for mounting on the upper end of a straight ski stick (1), a curved extension (3) having a convex side wall (5, 5'), said extension being secured to and extending up above said fitting element, a cavity space (9) within the curved extension, gripping means (11, 12) for a wriststrap disposed within the cavity space (9), and an outlet opening (8) for said wriststrap in the convex side wall (5, 5') of the curved extension, said gripping means being formed as a buckle having a frame portion (11) and a lever portion (12) pivotably journalled to the frame portion (11) so as to lock a free end of said wriststrap therebetween, said lever portion (12) forming a cover for the upper end of said cavity space (9), the outlet opening (8) for said wriststrap (4) being located immediately adjacent to the ski stick center line (6), the gripping means (11, 12) being located on the other side of said center line (6), the outer surface of said convex side wall (5, 5') extending above said outlet opening (8) so as to provide a high face surface, the center axis (7) of the curved extension (3) forming an angle ($\alpha$) which is between 15° to 40° with respect to the center line (6) of the straight stick portion.

2. A handle for a ski stick according to claim 1, characterized in that the convex side (5') of the curved extension (3) is staggered with respect to the fitting element (2).

3. A handle for a ski stick according to claim 2, characterized in that there is a hole (17) at the upper end of the fitting element (2'), said hole (17) communicating with said outlet (8) for said wriststrap and being located, as viewed in the direction of the ski stick center line (6), in line with a wall portion (18) forming said high face surface.

4. A handle for a ski stick according to claim 3, characterized in that said hole (17) and said wall portion (18) are both located immediately adjacent the ski stick center line (6).

* * * * *